US011014698B2

(12) United States Patent
Schulz

(10) Patent No.: US 11,014,698 B2
(45) Date of Patent: May 25, 2021

(54) STRAPPING APPARATUS WITH BAYONET

(71) Applicant: Signode Industrial Group LLC, Glenview, IL (US)

(72) Inventor: Friedhelm Schulz, Wipperfürth (DE)

(73) Assignee: Signode Industrial Group LLC, Glenview, IL (US)

( * ) Notice: Subject to any disclaimer, the term of this patent is extended or adjusted under 35 U.S.C. 154(b) by 275 days.

(21) Appl. No.: 15/752,039

(22) PCT Filed: Aug. 15, 2016

(86) PCT No.: PCT/US2016/046984
§ 371 (c)(1),
(2) Date: Feb. 12, 2018

(87) PCT Pub. No.: WO2017/027871
PCT Pub. Date: Feb. 16, 2017

(65) Prior Publication Data

US 2018/0229869 A1 Aug. 16, 2018

(30) Foreign Application Priority Data

Aug. 13, 2015 (DE) ..... 10 2015 113 353.9

(51) Int. Cl.
*B65B 13/06* (2006.01)

(52) U.S. Cl.
CPC ..... *B65B 13/06* (2013.01)

(58) Field of Classification Search
CPC ..... B65B 13/04; B65B 13/06; B65B 13/08; B65B 13/18; B65B 43/26; B23Q 1/70; B23Q 3/00; B23P 19/00
(Continued)

(56) References Cited

U.S. PATENT DOCUMENTS 3,150,585 A 9/1964 Sterner
3,150,586 A 9/1964 Snider
(Continued)

FOREIGN PATENT DOCUMENTS

DE 102011121946 A1 6/2013
DE 102013004448 B3 3/2014
(Continued)

OTHER PUBLICATIONS

JP54 51696 A, Machine Translation (Year: 1977).*
(Continued)

*Primary Examiner* — Adam J Eiseman
*Assistant Examiner* — Fred C Hammers
(74) *Attorney, Agent, or Firm* — Neal, Gerber & Eisenberg LLP

(57) ABSTRACT

A strapping apparatus (10) for packages (16) has a frame-like strapping channel which is composed of an upper and a lower channel section (19) which are connected by way of a first and a second vertical section (18, 20). A first diverting device connects (21) the first vertical section to the lower channel section, and a second diverting device (22) connects the lower channel section to the second vertical section. A bayonet (24) which can be inserted along a movement path alternative to the lower channel section (19) into the strapping channel, in which the insertion movement is directed from the first to the second diverting device. The first diverting device is mounted on a pivot axle (27) by means of which the first diverting device can be moved from a normal position, which connects the first vertical section and the lower channel section, into a deflected position, in which the connection is eliminated. A guide element is arranged on that end of the bayonet which is averted from the bayonet tip, which guide element connects the first vertical section to a channel section formed by the bayonet.

20 Claims, 4 Drawing Sheets

(58) Field of Classification Search
USPC ..... 100/8, 25, 26; 53/589, 582, 484, 382.1
See application file for complete search history.

(56) References Cited

U.S. PATENT DOCUMENTS

| | | | | | |
|---|---|---|---|---|---|
| 3,213,781 | A | | 10/1965 | Collins et al. | |
| 3,279,354 | A | | 10/1966 | Dickens et al. | |
| 3,376,807 | A | * | 4/1968 | Sterner | B65B 13/06 100/26 |
| 4,228,733 | A | | 10/1980 | Davis et al. | |
| 5,355,786 | A | * | 10/1994 | Tipton | B65B 13/06 100/25 |
| 5,355,789 | A | * | 10/1994 | Tipton et al. | B65B 13/04 100/25 |
| 2006/0168917 | A1 | | 8/2006 | Ashkenazi | |

FOREIGN PATENT DOCUMENTS

| | | | | | |
|---|---|---|---|---|---|
| DE | 202015104276 | U1 | | 8/2015 | |
| JP | 54 051696 | A | * | 4/1979 | B65B 13/06 |
| JP | S5451696 | A | | 4/1979 | |
| JP | S5648909 | A | | 5/1981 | |
| JP | S5668604 | U | | 6/1981 | |
| JP | H0453604 | U | | 5/1992 | |
| JP | H0433202 | Y2 | | 8/1992 | |
| JP | 2555381 | B2 | | 11/1996 | |
| SU | 1567450 | A1 | | 5/1990 | |
| WO | 2008128661 | A1 | | 10/2008 | |

OTHER PUBLICATIONS

Written Opinion issued by ISA/EPO in connection with EP16754133 dated Jan. 21, 2019.

European Search Report issued by ISA/EPO in connection with EP16754133 dated Jan. 9, 2019.

International Preliminary Report on Patentability issued by ISA/EPO in connection with PCT/US2016/046984 dated Feb. 22, 2018.

* cited by examiner

STRAPPING APPARATUS WITH BAYONET

BACKGROUND

The disclosure relates to a strapping apparatus for packages,

- having a frame-like strapping channel which is composed of an upper and a lower channel section which are connected by way of a first and a second vertical section,
- having a first diverting device which connects the first vertical section to the lower channel section,
- having a second diverting device which connects the lower channel section to the second vertical section,
- having a bayonet which can be inserted along a movement path alternative to the lower channel section into the strapping channel, wherein the insertion movement is directed from the first to the second diverting device.

A strapping apparatus of said type is disclosed for example in the applicant's DE 10 2013 004 448 B3 and DE 10 2011 121 946 A1. Said strapping apparatuses serve generally for the strapping of large packages, which are commonly arranged on pallets. A packing table equipped with rollers serves for receiving the package and for moving the package through the apparatus. The apparatus then generally has, to the side of the packing table, in each case one vertical support on which there is arranged a horizontally oriented pressing plate. The pressing plate is movable along the vertical supports. A strapping means channel which is situated in sections in the pressing plate and in the packing table and which is arranged along the vertical supports, surrounds the package to be strapped.

During the strapping of packages which are mounted on pallets, fixing of the package to the pallet by way of the strapping band is desirable. For this purpose, a bayonet is inserted between pallet deck and pallet skid, which bayonet is utilized instead of the channel section arranged in the packing table for leading the strapping means through under the pallet deck.

During the strapping process, the strapping means is, proceeding from a feed and sealing apparatus that is generally arranged in the pressing plate, guided along the first vertical support through the lower channel section, which is situated in the packing table, or the bayonet, and via the channel section of the second vertical support back into the channel section in the pressing plate and to the feed and sealing apparatus. Here, the band end is held, and the strapping means is then retracted. Here, the strapping means emerges from the strapping channel, which for this purpose has different opening devices. The strapping means is stretched around the package. The band ends are fixedly connected to one another. The strapping process is thereafter complete.

To transfer the strapping means from one channel section into the next, diverting devices are provided in the corner regions. In particular, a first diverting device is situated between the first vertically directed channel section and the lower channel section, and a second diverting device is situated between the lower channel section and the second vertically directed channel section. The diverting devices have a base surface which describes a radius which effects a diversion of the band in the corner regions of adjacent channel sections.

However, in the prior art, which is not demonstrable by documentation, the diverting devices impede the insertion of the bayonet into the strapping channel, because said diverting devices are arranged at least partially in the movement path of the bayonet. In said prior art, which is not demonstrable by documentation, the diverting devices are divided vertically into two parts. If it is intended to utilize the bayonet alternatively to the lower channel section, said bayonet spreads the diverting devices apart.

The spreading-apart of the diverting devices for the purposes of making space for the bayonet has proven to be disadvantageous in the prior art. The mechanical components for this purpose are of relatively complex construction, such that malfunctions commonly occur. Furthermore, the diversion of the band during the feeding into the strapping channel at the transition of the vertical channel sections to the bayonet is not reliably ensured from every aspect.

SUMMARY

It is an object of the device to improve the diversion of the strapping means at the transition from the vertically directed channel section into the bayonet and back into the next vertically directed channel section. The object of the device is achieved by a strapping apparatus in which the first diverting device is mounted on a pivot axle by means of which the diverting device can be moved from a normal position, which connects the first vertical section and the lower channel section, into a deflected position, in which the connection is eliminated, and a guide element is arranged on that end of the bayonet which is averted from the bayonet tip, which guide element connects the first vertical section to a channel section formed by the bayonet.

The major advantage of the device can firstly be seen in the fact that the first diverting device can be moved in a mechanically very simple manner from its normal position into a deflected position, and thus clears the movement path for the insertion of a bayonet into the strapping channel. For this purpose, the diverting device preferably pivots downward, and in its deflected position, is arranged entirely below the bayonet. Furthermore, the bayonet has, on its end averted from the tip, a dedicated guide element, which now replaces the diverting device situated in the deflecting position and by way of which the first vertical section is connected to the bayonet for optimum band guidance.

It is provided that the first diverting device is arranged in the movement path of the bayonet, and the movement from the normal position into the deflected position is induced by the bayonet.

It is also provided that the pivot axle is directed parallel to the packing table and transversely with respect to the movement path of the bayonet, and the pivoting movement is directed downward in the direction of gravitational force.

It is particularly preferable if the first diverting device is equipped with a return element by way of which the first diverting device can be returned from its deflected position into the normal position, in particular if the return element is formed by a spring element, counter to the spring force of which the first diverting device can be moved from its normal position into the deflected position.

It is also provided that the bayonet tip is equipped with a lug which forms the channel base, wherein the channel base, which is formed by the lug, is curved in an upward direction pointing away from the packing table.

The configuration of the bayonet tip in the proposed manner has the effect that the transition from the bayonet into the second vertical channel section is reliably ensured. This is improved in particular by virtue of the fact that a guide tongue is arranged above the lug so as to form a gap.

It is provided that the second diverting device is arranged in the movement path of the bayonet and has a receptacle for the bayonet tip, in particular if it is the case that, when the bayonet has been inserted into the strapping channel, the lug of the bayonet tip forms the transition between the channel section of the bayonet and a channel section of the second diverting device.

In this way, the second diverting device, which is intended in particular to ensure the transition between the lower channel section and the second vertical channel section, can, together with the specially designed bayonet tip, ensure ideal band guidance by the bayonet in the second channel section.

DESCRIPTION OF THE FIGURES

Further advantages and improved understanding of the disclosure will emerge from the following description of the drawings, in which.

DETAILED DESCRIPTION

In the figures, a strapping apparatus according to an embodiment is denoted as a whole by the reference designation 10.

Figure 1:
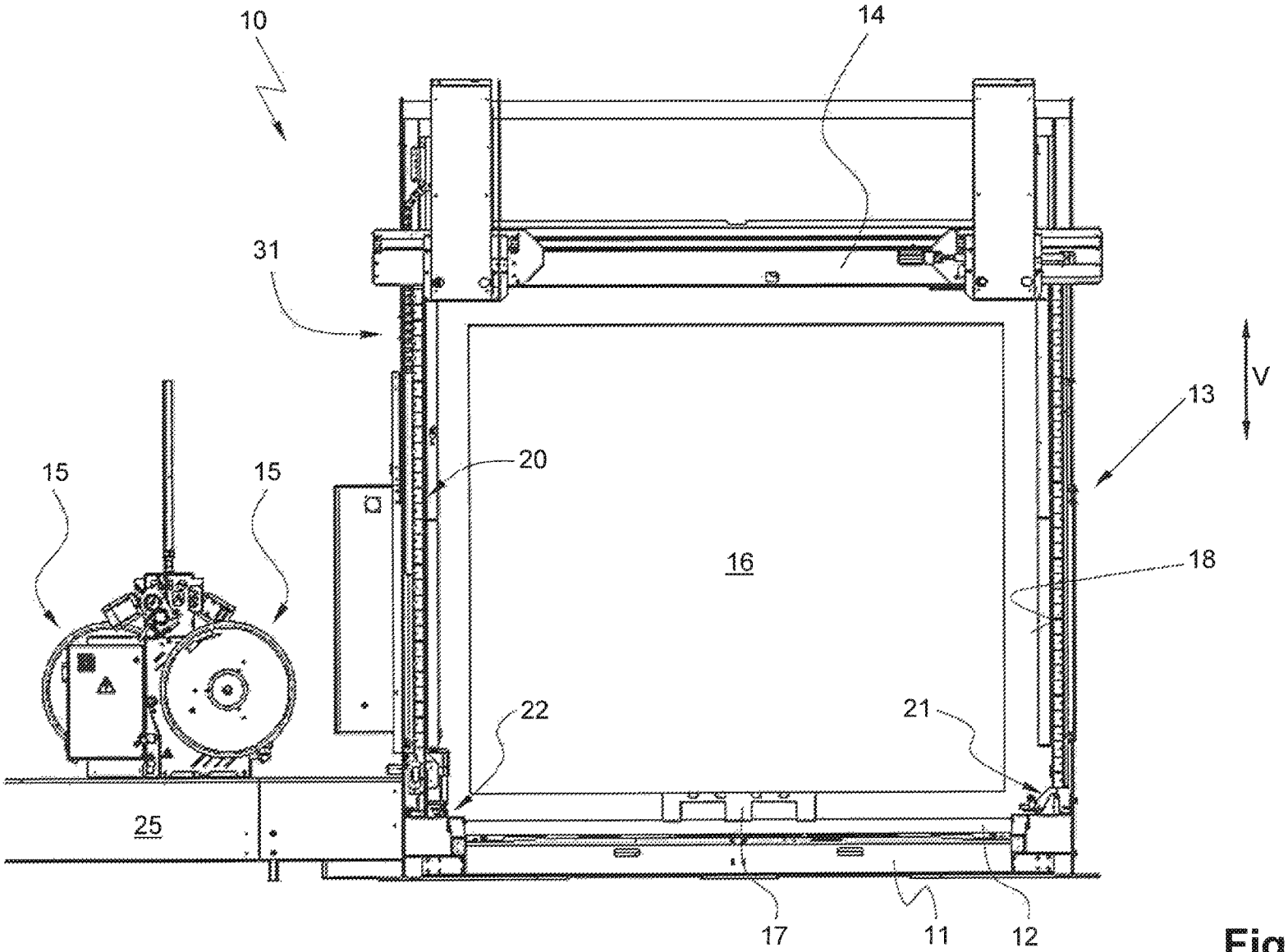
FIG. 1 shows a strapping apparatus according to an embodiment.

The strapping apparatus is illustrated in its entirety in FIG. 1. Said strapping apparatus comprises firstly a packing table 11 which is arranged at the bottom and which bears rollers or drums 12. On both sides of the packing table 11 there are arranged vertical supports 13 which bear a horizontally oriented pressing plate 14.

The pressing plate 14 is movable along the vertical supports 13 in a vertical direction V. On the left-hand side in FIG. 1 with regard to the plane of the paper, there are arranged band stores 15 which serve for the supply of strapping means.

The packing table 11, with the pressing plate 14 arranged thereabove, and the vertical supports 13 form a frame through which a package 16 can be moved on a pallet 17.

A strapping channel is composed of four sections. An upper channel section is arranged in the pressing plate and transitions into a first vertical section 18, which runs along a vertical support 13. The first vertical section 18 is connected to the lower channel section 19 and transitions into the second vertical section 20. The second vertical section 20 is in turn arranged on a vertical support 13. In this way, the upper channel section arranged in the pressing plate 17, and the channel section 19 arranged in the packing table 11, are connected to one another by the first and second vertical sections 18, 20.

During the strapping of the package, a strapping means, normally in the form of a band, is guided through the strapping channel by a feed and sealing device arranged in the pressing plate. The feed and sealing device feeds the band firstly into the upper channel section, from which said band slides along the first vertical section 18 into the lower channel section 19 and then into the second vertical section 20. From the second vertical section 20, said band is guided via the upper channel section back to the feed and sealing device. There, the band end is held. The band is retracted and is stretched around the package 16. The band ends are subsequently welded to one another.

To ensure clean band guidance in the transition regions between the first vertical section 18 and the lower channel section 19 and between the lower channel section 19 and the second vertical section 20, diverting devices 21 and 22 are used there. The first diverting device 21 leads the band from the first vertical section 18 into the lower channel section 19. The second diverting device 22 leads the band from the lower channel section 19 into the second vertical section 20. The construction of the diverting devices 21 and 22 is substantially identical, such that the general function thereof can be discussed on the basis of FIG. 3.

Figure 3:
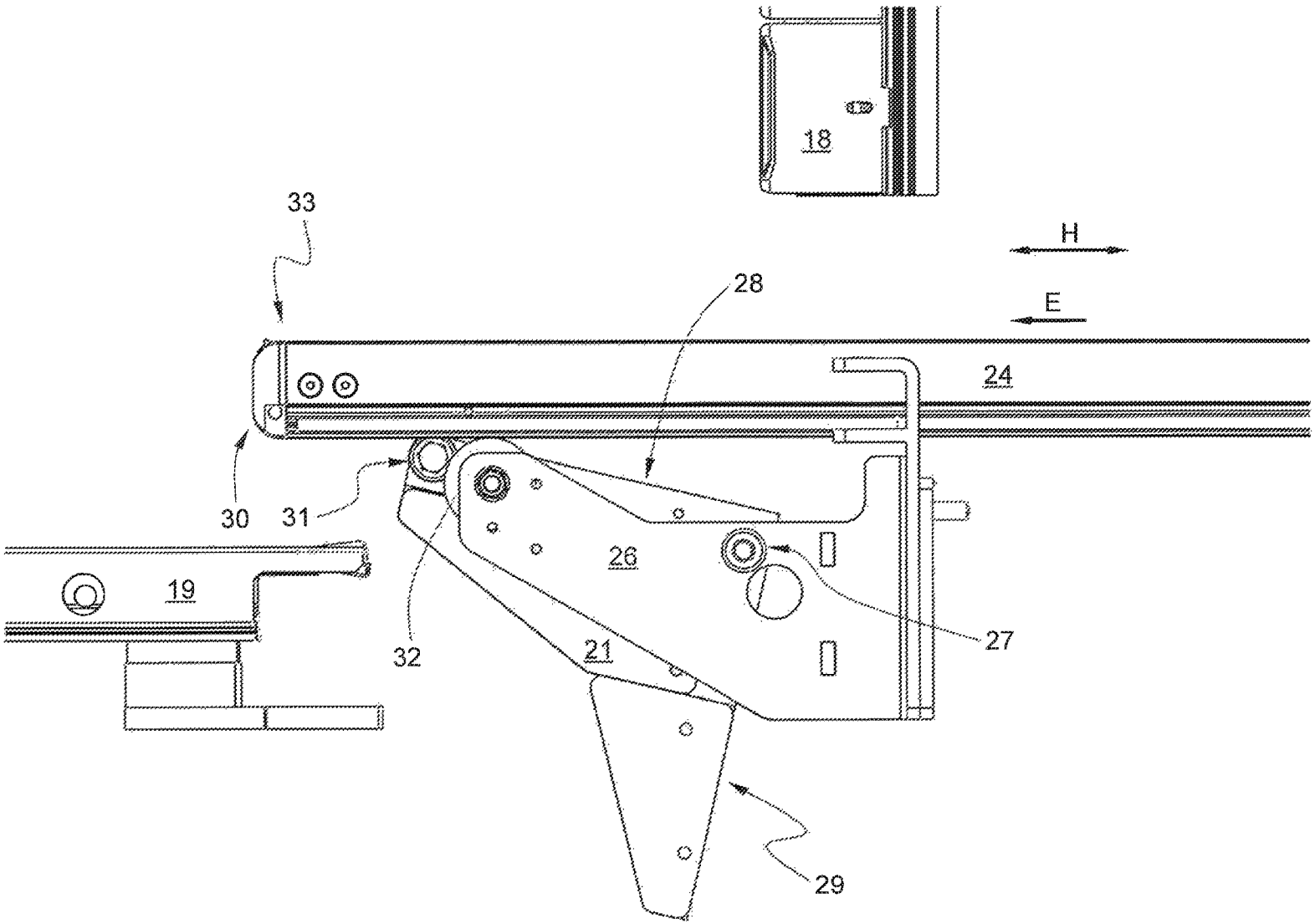
FIG. 3 is the illustration as per FIG. 2, with a bayonet partially inserted.
Figure 4:
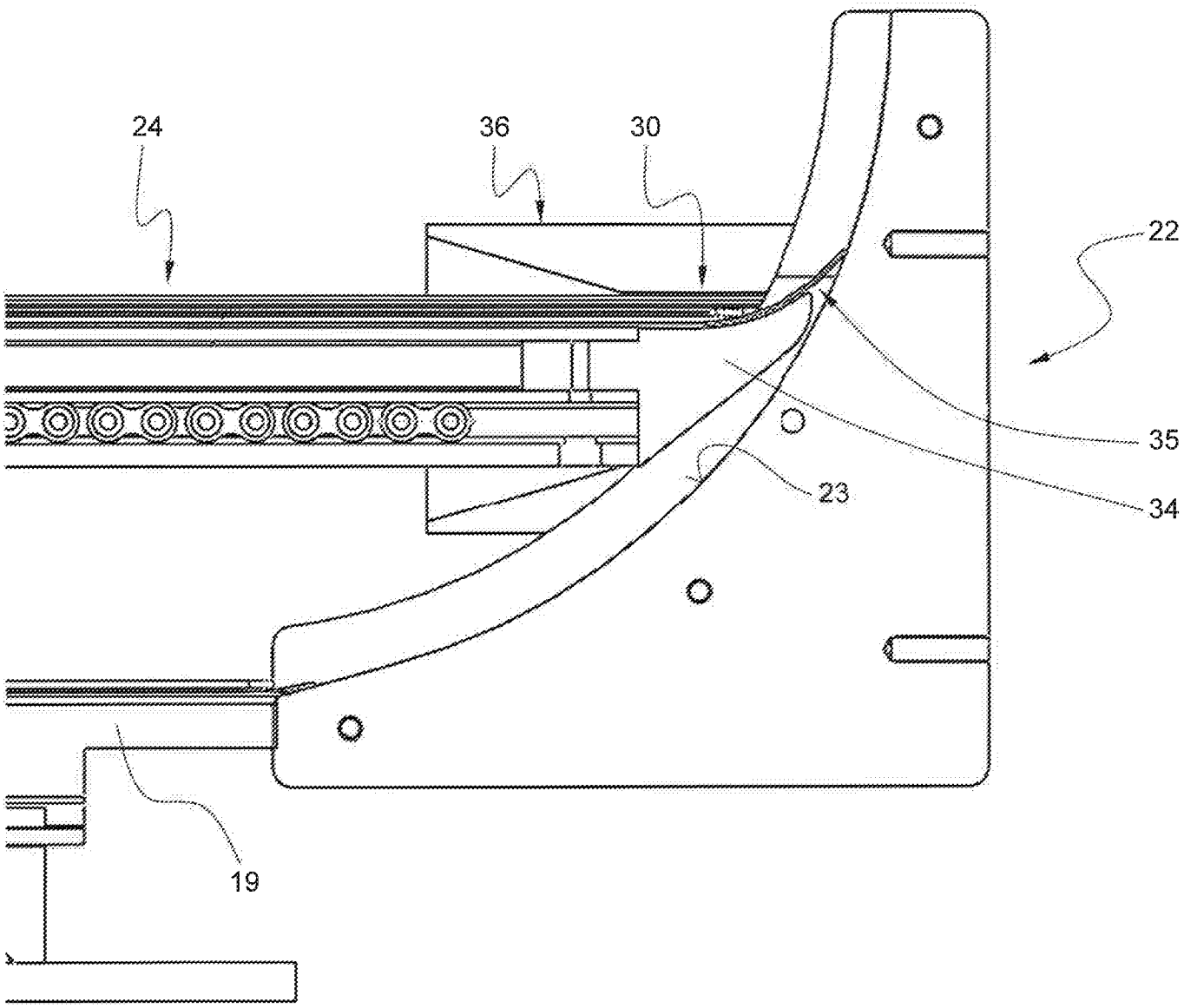
FIG. 4 is the illustration of the interaction of the bayonet tip and the diverting device.

FIGS. 3 and 4 illustrate the second diverting device 22. Said second diverting device has a guide surface 23 which, in said region, forms the channel base and describes a radius, such that the band is transferred from the vertical into the horizontal (first diverting device 21) and from the horizontal into the vertical (second diverting device 22).

The strapping apparatus has, adjacent to the lower channel section 19, a bayonet 24. When not in use, the bayonet 24 is mounted in a bayonet box 25 (see FIG. 1). If it is the intention, during the strapping process, for a strapping band to fix the package 16 to the pallet 17, it is necessary for the strapping band to be led through between the pallet deck and pallet skid. In this case, the bayonet 24 is inserted into the strapping channel such that the strapping band runs not through the lower channel section 19 but through a channel section of the bayonet. The bayonet 24 to be inserted is, for the strapping process, then arranged parallel to the lower channel section 19, but is spaced apart therefrom and is situated between the pallet deck and pallet skid. In this way, the strapping band is led between the pallet deck and pallet skid and can fasten the package 16 to the pallet.

The diverting devices 21 and 22 illustrated in FIG. 1 are, owing to the fact that they connect the lower channel section 19 to the first and to the second vertical section 18, 20 respectively, situated in the movement path of the bayonet 24. In the prior art, cumbersome spreading mechanisms were provided in order to enable the bayonet 24 to be inserted into the strapping channel.

Figure 2:
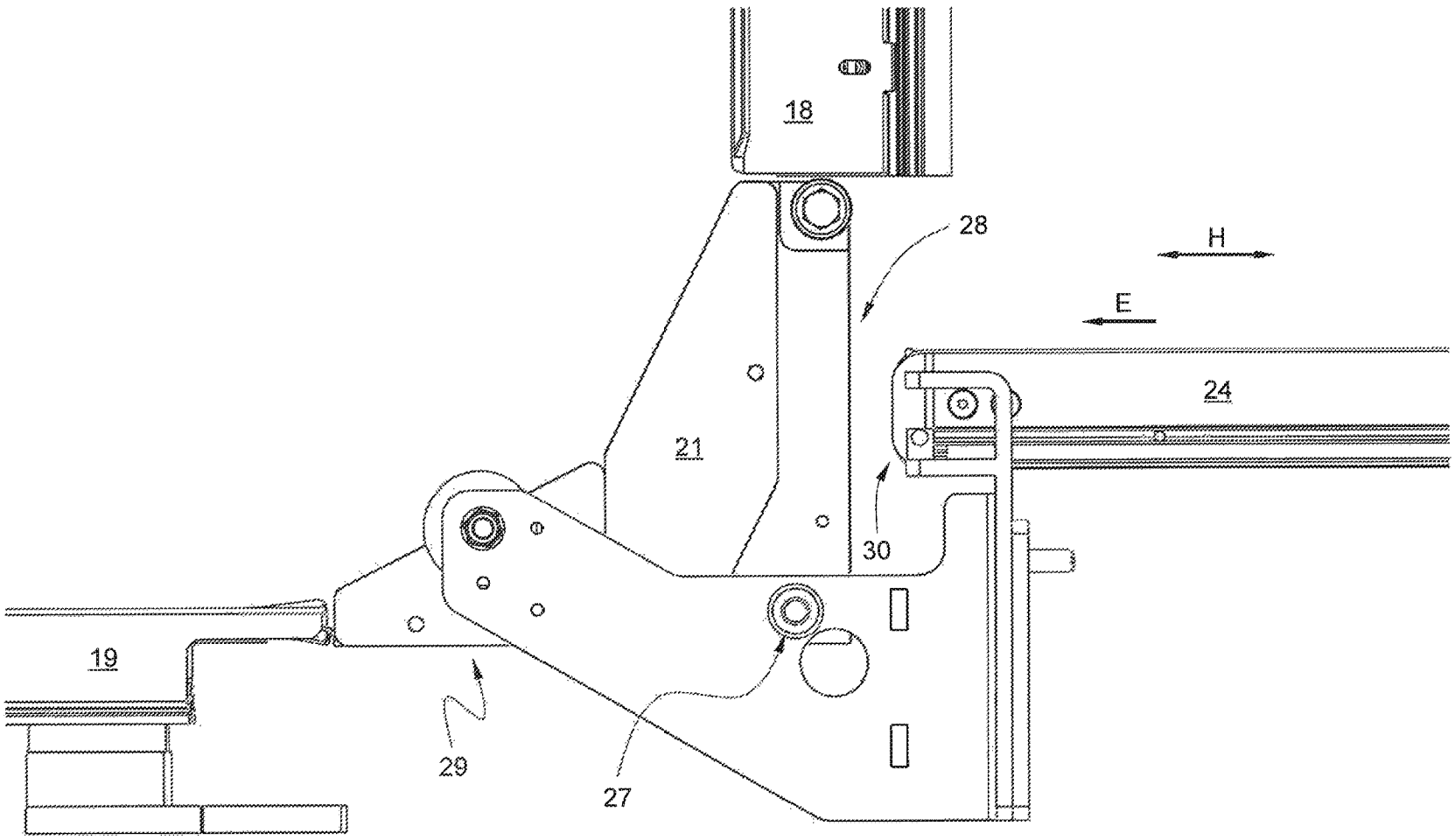
FIG. 2 is a partial illustration of the strapping channel at the transition from the first vertical section to the lower channel section.

On the basis of FIGS. 2 and 3, the disclosure proposes, with regard to the first diversion 21 which couples the first vertical section 18 to the lower channel section 19, an alternative to the spreading mechanisms hitherto used.

FIGS. 2 and 3 illustrate the first vertical section 18, the first diverting device 21, the lower channel section 19, the bayonet 24 and a support component 26, with the load-bearing machine parts being omitted. It can be seen very clearly from FIG. 2 how the band is transferred from the first channel section 18 into the lower channel section 19 by the interposed first diverting device 21. It is also possible to see the bayonet 24 which can be inserted into the strapping channel in the horizontal direction H. It can also be seen from FIG. 2 that the first diverting device 21 is arranged in the movement path of the bayonet 24 and, in principle, disrupts the insertion thereof.

According to an embodiment, the first diverting device 21 is equipped with a pivot axle 27 about which it can be pivoted out of the movement path of the bayonet 24. In the specific embodiment of FIG. 2, the pivot axle is directed parallel to the packing table 11 and transversely with respect to the movement path of the bayonet 24 and couples the first diverting device 21 to the support component 26. The pivot axle 27 is furthermore arranged underneath the movement path of the bayonet 24. The first diverting device 21 has a vertically oriented back part 28 and a horizontally oriented base part 29 when it is situated in the normal position illustrated in FIG. 2, in which the vertical section 18 and the lower channel section 19 are connected. During a movement of the bayonet 24 in the insertion direction E, the front end 30 of the bayonet 24 strikes the back part 28 of the first diverting device 21. Since the pivot axle 27 is arranged below the movement path of the bayonet 24, it is the case that, during a continued insertion movement E, the bayonet 24 forces the first diverting device 21 to perform a pivoting movement about the pivot axle 27, such that the back part 28 is pivoted downward out of the movement path of the bayonet 24. Here, the first diverting device 21 reaches its deflected position and clears the movement path for the bayonet 24.

FIG. 3 illustrates the first diverting device 21 in its deflected position. The bayonet 24 has been inserted over a partial distance along its movement path into the strapping channel and, in the process, has forced the first diverting device 21 to perform the pivoting movement. The connection between the first vertical section 18 and the lower channel section 19 has, in this way, been eliminated. FIG. 3 shows the function of a wheel 31 arranged at the free end of the back part 28 and of a roller 32 arranged at the free end of the support component 26. The roller 32 arranged on the support component serves for the assistive stabilization of the bayonet 24. The wheel 31 arranged on the back part 28 of the first diverting device 21 permits a movement of the bayonet relative to the back part 28 with reduced wear. This is all the more important in the preferred exemplary embodiment because the pivoting from the normal position (FIG. 2) into the deflected position (FIG. 3) takes place counter to a restoring force which forces the first diversion 21 to perform a return movement into the normal position. Said restoring force is preferably effected by a spring element (not illustrated here).

Worthy of mentioning, but not illustrated, is the fact that the bayonet 24 bears, on its end averted from the bayonet tip 33, a guide element which corresponds in terms of function and construction to the first diverting device 21, and which produces a connection, which guides the strapping band 35, between the first vertical section 18 of the strapping channel and the channel section on the bayonet.

The disclosure also proposes that the diversion of the strapping means between the bayonet 24 and the second vertical section 20 of the strapping channel in the region of the second diverting device 22 be configured differently than in the prior art. For this purpose, the bayonet tip 33 has a lug, whose surface pointing away from the packing table 11 has a radius in the direction of the second vertical section 20 and which thus guides the strapping band 35 in an arc onto the guide surface 23 of the second diverting device 22. To receive the front end 30 of the bayonet 24, the second diverting device 22 has a receptacle 36 which holds the bayonet 24 in the correct position for optimum band guidance. It is conceivable for the bayonet tip 33 to have, above the lug 34, a gap-forming guide tongue which is then likewise bent upward in the direction of the second vertical section 20. In this way, a guide gap for the strapping band 35 is formed between lug 34 and guide tongue, which guide gap ensures stable guidance of the band 35 from the bayonet 24 into the second vertical section 20 of the strapping channel.

By way of the diverting device 21, which is configured so as to be pivotable, and the guide element on the bayonet, on the one hand, and the specially configured bayonet tip 33, on the other, it is possible to dispense with the spreadable diverting devices known from the prior art with their complex mechanical components, and thus to ensure a band guide of simple construction and reliable function at the transition between the bayonet 24 and the first and second vertical sections 18 and 20 respectively.

LIST OF REFERENCE DESIGNATIONS

10 Strapping apparatus
11 Packing table
12 Drum/roller
13 Vertical support
14 Pressing plate
15 Band store
16 Package
17 Pallet
18 First vertical section of the strapping channel
19 Lower channel section of the strapping channel
20 Second vertical section of the strapping channel
21 First diverting device between 18 and 19
22 Second diverting device between 19 and 20
23 Guide surface
24 Bayonet
25 Bayonet box
26 Support component
27 Pivot axle
28 Back part
29 Base part
30 Front bayonet end
31 Wheel
32 Roller
33 Bayonet tip
34 Lug
35 Strapping band
36 Receptacle
V Vertical direction
H Horizontal direction
E Insertion direction

The invention claimed is:

1. A strapping apparatus comprising:

a packing table;

spaced-apart upper and lower channel sections connected to each other by spaced-apart first and second side channel sections, wherein the upper and lower channel sections and the first and second side channel sections form a strapping channel encircling the packing table;

a first diverting device which connects the first side channel section to the lower channel section, wherein the first diverting device comprises a base part and a back part transverse to the base part, wherein the first diverting device is mounted on a pivot axle and is pivotable between a normal position and a deflected position, wherein when the first diverting device is in the normal position the back part is generally aligned with the first side channel section and the base part is generally aligned with the lower channel section so the first diverting device connects the first side channel section and the lower channel section, wherein when the first diverting device is in the deflected position the back part is not aligned with the first side channel section and the base part is not aligned with the lower channel section so the first diverting device does not connect the first side channel section and the lower channel section;

a second diverting device which connects the lower channel section to the second side channel section;

a bayonet comprising a bayonet channel section, wherein the bayonet can be moved along a movement path directed from the first diverting device to the second diverting device such that, after the bayonet has reached the end of the movement path, the bayonet channel section, the upper channel section, and part of the first and second side channel sections form an alternative strapping channel, wherein the pivot axle is positioned underneath the bayonet such that movement of the bayonet along the movement path causes the bayonet to force the first diverting device to pivot so the back part pivots toward the packing table and the base part pivots away from the packing table as the first diverting device pivots from the normal position to the deflected position; and a guide element arranged on an end of the bayonet which is spaced-apart from a bayonet tip, which guide element connects the first side channel section to the bayonet channel section after the bayonet has reached the end of the movement path.

2. The strapping apparatus of claim 1, wherein the pivot axle is oriented parallel to the packing table and transverse to the movement path of the bayonet.

3. The strapping apparatus of claim 1, wherein the first diverting device is equipped with a spring configured to return the first diverting device from its deflected position into its normal position.

4. The strapping apparatus of claim 1, wherein the bayonet tip is equipped with a lug which forms part of a base of the bayonet channel section, wherein the base is curved in an upward direction pointing away from the packing table.

5. The strapping apparatus of claim 4, wherein a guide tongue is arranged above the lug so as to form a gap.

6. The strapping apparatus of claim 4, wherein the second diverting device is arranged in the movement path of the bayonet and has a receptacle for the bayonet tip.

7. The strapping apparatus of claim 4, wherein, after the bayonet has reached the end of the movement path, the lug of the bayonet tip forms a transition between the bayonet channel section and a channel section of the second diverting device.

8. A strapping machine comprising:

first and second side components defining respective first and second side strapping channel sections;

a lower component at least partially between the first and second side components and defining a lower strapping channel section;

a first diverting device pivotable between: (1) a normal position in which the first diverting device connects the first side strapping channel section and the lower strapping channel section; and (2) a deflected position in which the first diverting device does not connect the first side strapping channel section and the lower strapping channel section; and a bayonet that defines a bayonet strapping channel section and that is movable relative to the first and second side components, the lower component, and the first diverting device between a retracted position and an inserted position, wherein the first diverting device is pivotable about a pivot axis of a pivot axle such that movement of the bayonet from the retracted position to the inserted position causes the bayonet to contact the first diverting device to force the first diverting device to pivot from the normal position into the deflected position, wherein the pivot axis is positioned underneath the bayonet, is transverse to the bayonet strapping channel section, and is transverse to the first and second side strapping channel sections, wherein when the bayonet is in the inserted position, the bayonet strapping channel section is connected to the first and second side strapping channel sections.

9. The strapping machine of claim 8, further comprising an upper component supported by the first and second side components and defining an upper strapping channel section that connects the first and second side strapping channel sections.

10. The strapping machine of claim 9, wherein the upper component comprises a press plate movable relative to the first and second side components and the lower component between an upper position and a lower position.

11. The strapping machine of claim 8, further comprising a second diverting device that, when the bayonet is in the retracted position, connects the lower strapping channel section and the second side strapping channel section.

12. The strapping machine of claim 11, wherein when the bayonet is in the inserted position, the second diverting device connects the bayonet strapping channel section and the second side strapping channel section.

13. The strapping machine of claim 12, wherein the second diverting device defines a receptacle configured to receive a front end of the bayonet.

14. The strapping machine of claim 13, wherein the front end of the bayonet comprises an upwardly curved lug.

15. The strapping machine of claim 8, wherein the first diverting device comprises a roller, wherein the roller is positioned to engage the underside of the bayonet when the first diverting device is in the deflected position and the bayonet is in the inserted position.

16. The strapping machine of claim 15, further comprising a biasing element that biases the first diverting device to the normal position.

17. The strapping machine of claim 8, wherein the first and second side components are vertical supports, wherein the lower component is horizontal.

18. The strapping machine of claim 8, wherein the first diverting device comprises a base part and a back part oriented transverse to one another, wherein when the first diverting device is in the normal position, the back part is generally aligned with the first side strapping channel section and the base part is generally aligned with the lower strapping channel section, wherein when the bayonet is in its inserted position and the first diverting device is in its deflected position, the base part and the back part of the first diverting device are both entirely beneath the bayonet.

19. A strapping machine comprising:

first and second side components defining respective first and second side strapping channel sections;

a lower component at least partially between the first and second side components and defining a lower strapping channel section;

a first diverting device pivotable between: (1) a normal position in which the first diverting device connects the first side strapping channel section and the lower strapping channel section; and (2) a deflected position in which the first diverting device does not connect the first side strapping channel section and the lower strapping channel section; and a bayonet that defines a bayonet strapping channel section and that is movable relative to the first and second side components, the lower component, and the first diverting device between a retracted position and an inserted position, wherein the first diverting device is pivotable about a pivot axis of a pivot axle such that movement of the bayonet from the retracted position to the inserted position causes the bayonet to force the first diverting device to pivot from the normal position into the deflected position, wherein the pivot axis is positioned underneath the bayonet, is transverse to the bayonet strapping channel section, and is transverse to the first and second side strapping channel sections, wherein when the bayonet is in the inserted position, the bayonet strapping channel section is connected to the first and second side strapping channel sections, wherein the first diverting device comprises a roller, wherein the roller is positioned to engage the underside of the bayonet when the first diverting device is in the deflected position and the bayonet is in the inserted position.

20. The strapping machine of claim 19, further comprising a biasing element that biases the first diverting device to the normal position.

* * * * *